US007694492B2

(12) United States Patent
Van Ballegooijen et al.

(10) Patent No.: US 7,694,492 B2
(45) Date of Patent: Apr. 13, 2010

(54) GRIPPING DEVICE, PACKAGING MACHINE AND METHOD FOR PLACING BOXES IN AN OUTER PACKAGING

(75) Inventors: Geert Antoine Van Ballegooijen, Wijk en Aalburg (NL); Arie Gerard Van Ballegooijen, Wijk en Aalburg (NL)

(73) Assignee: FPS Food Processing Systems B.V. (NL)

( * ) Notice: Subject to any disclaimer, the term of this patent is extended or adjusted under 35 U.S.C. 154(b) by 393 days.

(21) Appl. No.: 11/578,714

(22) PCT Filed: Apr. 1, 2005

(86) PCT No.: PCT/EP2005/003529

§ 371 (c)(1),
(2), (4) Date: Mar. 12, 2007

(87) PCT Pub. No.: WO2005/100157

PCT Pub. Date: Oct. 27, 2005

(65) Prior Publication Data

US 2007/0251193 A1 Nov. 1, 2007

(30) Foreign Application Priority Data

Apr. 16, 2004 (NL) ..... 1025964

(51) Int. Cl.
*B65B 5/00* (2006.01)

(52) U.S. Cl. ..... 53/260; 53/257; 53/473

(58) Field of Classification Search ..... 53/260, 53/258, 257, 475, 473, 173, 249; 414/751.1, 414/753.1

See application file for complete search history.

(56) References Cited

U.S. PATENT DOCUMENTS 4,303,269 A * 12/1981 Faughnan ..... 294/88
4,503,798 A * 3/1985 Hergeth ..... 414/751.1
5,176,243 A * 1/1993 Temming et al. ..... 198/400

(Continued)

FOREIGN PATENT DOCUMENTS

EP 0 476 301 A 3/1992

(Continued)

*Primary Examiner*—Sameh H. Tawfik
(74) *Attorney, Agent, or Firm*—Stites & Harbison PLLC; Marvin Petry; Douglas E. Jackson

(57) ABSTRACT

The invention relates to a gripping device (2) for placing boxes (1), in particular egg boxes, in an outer packaging, wherein the gripping device comprises a amobile frame (3); grippers (4) placed on both sides of the frame in such a way that in use the grippers are situated on both sides of the box, whereby the grippers can be moved between a box supporting position and an unloading position, wherein each gripper is formed by a mainly pen-shaped body with a hook-shaped end (6), whereby at least the hook-shaped end (6) can be rotated around the longitudinal axis of the gripper, and wherein the grippers on the one side of the box are attached staggeringly in relation to the grippers on the other side of the box.

11 Claims, 10 Drawing Sheets

U.S. PATENT DOCUMENTS

| | | | | |
|---|---|---|---|---|
| 5,271,208 | A * | 12/1993 | Christine et al. | 53/436 |
| 5,330,242 | A * | 7/1994 | Lucky, Sr. | 294/88 |
| 5,338,150 | A | 8/1994 | Focke et al. | |
| 5,536,133 | A * | 7/1996 | Velez et al. | 414/620 |
| 5,558,380 | A * | 9/1996 | Meyer et al. | 294/88 |
| 5,749,453 | A * | 5/1998 | Doornekamp et al. | 198/400 |
| 6,237,978 | B1 * | 5/2001 | Bliss | 294/88 |
| 6,923,486 | B1 * | 8/2005 | Slagman | 294/115 |
| 2002/0005646 | A1 | 1/2002 | Accettura et al. | |

FOREIGN PATENT DOCUMENTS

| | | | |
|---|---|---|---|
| EP | 0 666 149 | A | 8/1995 |
| EP | 0 721 889 | A | 7/1996 |
| NL | 9 201 292 | A | 2/1994 |

* cited by examiner

GRIPPING DEVICE, PACKAGING MACHINE AND METHOD FOR PLACING BOXES IN AN OUTER PACKAGING

FIELD OF THE INVENTION

The present invention relates to a gripping device, a packaging machine and a method for placing boxes, in particulate egg boxes, in an outer packaging.

BACKGROUND OF THE INVENTION

Such a gripping device, packaging machine and method are known from NL-A-9201292. This known gripping device comprises two grippers formed by plates, the width of an egg box, clasping between them three or more egg boxes at the same time. The plates can swing outwards in order to unload the egg boxes. The egg boxes are unloaded by the plates on a lifting platform, which subsequently is lowered and around which an outer packaging is placed.

In addition, a device is known from U.S. Pat. No. 3,559,371, with which a stack of egg trays can be lifted and can be lowered into an outer packaging. This device comprises a frame and pens mounted into the frame with hook-shaped ends that can be rotated. Rotating the pens and lifting the egg trays with the aid of the device is effected by hand. Eggs are sorted as to weight and packed into egg boxes. The eggs are packed in the egg box in such a way that they do not touch or hardly touch each other. The eggs can be packed in various quantities, for instance six, ten or twelve eggs, per box. Therefore, the egg boxes can vary in outer dimensions, but also as to design or the material from which the box is made. Sorting and packing eggs into egg boxes is a fully automated process. Subsequently packing the egg boxes in outer packages is often still effected by hand, because there is no universal gripping device for placing varying egg boxes in an outer packaging.

When placing the egg boxes in an outer packaging, they are placed in a special pattern layer by layer. An outer packaging can be a cardboard box or a crate. The pattern depends on the outer dimensions of the egg box and can differ per layer. Ultimately, the egg boxes are packed in the outer packaging side by side with hardly any play.

BRIEF SUMMARY OF THE INVENTION

The object of the present invention is providing an improved gripping device for placing boxes, in particular egg boxes, in an outer packaging. A further object is providing a gripping device that can be universally applied. Universally is here intended to mean: for any (egg) box and any outer packaging. Still a further object of the present invention is providing such a gripping device with which (egg) boxes can be accurately placed without damage to the packaging or the contents, for instance eggs, in any desired position in the outer packaging.

To that end, the gripping device according to the invention is characterised in that each gripper is formed by a mainly pen-shaped body with a hook-shaped end, whereby at least the hook-shaped end can be rotated around the longitudinal axis of the gripper, and the grippers on the one side of the box are attached staggeringly in relation to the grippers on the other side of the box.

Because the pen-shaped body is small in size as to the width of its length, it can be retracted almost unhindered by the outer packaging, box or adjacent box. In addition, the pens will not hinder each other when several gripping devices are used next to each other for placing boxes in an outer packaging.

Furthermore, the grippers have been attached to the frame swivelling in relation to each other. When lifting a box, the grippers can be moved outwards, so that differences in the dimensions of the boxes can be overcome and the tolerance range for lifting boxes is extended. As soon as the grippers have been put into the position supporting the box, the grippers are swung back to their point of departure. This also results in a clasping effect.

Preferably, the grippers grip the box under its base in the box supporting position. Although there are many different egg boxes, the bases of all these egg boxes are almost the same. By using the common characteristics of the bases of the egg boxes when packing the egg boxes in an outer packaging, a gripping device is obtained that can be universally applied.

Preferably, the pen-shaped body has a mainly circular sectional plane. This has an advantageous effect on the unloading performance of the grippers.

In addition, the gripping device preferably comprises centering elements for centering the boxes in relation to the frame. The centering elements are preferably applied to the short sides of the box. In doing so, the centering elements also provide a fixation of the box during movements of the frame. The centering elements can advantageously serve as guiding elements when unloading the boxes into the outer packaging.

Preferably, the gripping device is further provided with a pressing element that can be moved in relation to the frame, which pressing element presses on the top of the box at least in the unloading position. The pressing element ensures that when unloading the box and retracting the grippers a force is applied to the box counter to the retraction direction. An additional advantageous effect of such a pressing element is that a maybe loose cover of an egg box can be closed.

The invention further relates to a packaging machine for packing boxes into an outer packaging, wherein the grippers on the one side of the frame are attached staggeringly in relation to the grippers on the other side of the frame of the gripping device.

Preferably, a number of gripping devices positioned next to each other are provided and the gripping devices can jointly be moved between the feed belt and the filling point. Each box is directly and individually gripped by a gripping device, so that a reliable packaging machine is obtained. In a very advantageous embodiment, the gripping devices can be moved in relation to each other. This makes it possible to make up the boxes in a formation in the air during the transport from the lifting point to the filling point. Due to this, a particularly compact packaging machine is created. Finally, the feed belt is preferably provided with openings for the passage of the grippers, so that the grippers can grip the boxes at their bottom sides or bases.

The invention further relates to a method for placing boxes in an outer packaging, wherein each box is individually supported by grippers. Due to this, fewer breakdowns will occur in the packaging process compared with the method known from the prior art.

An exceptionally fast packaging process is obtained, when the boxes make up a formation during the transport to the positions in the outer packaging.

BRIEF DESCRIPTION OF THE DRAWINGS

The invention will be further elaborated by way of the attached drawings. The drawings illustrate as follows.

DETAILED DESCRIPTION OF THE INVENTION

Figure 1:
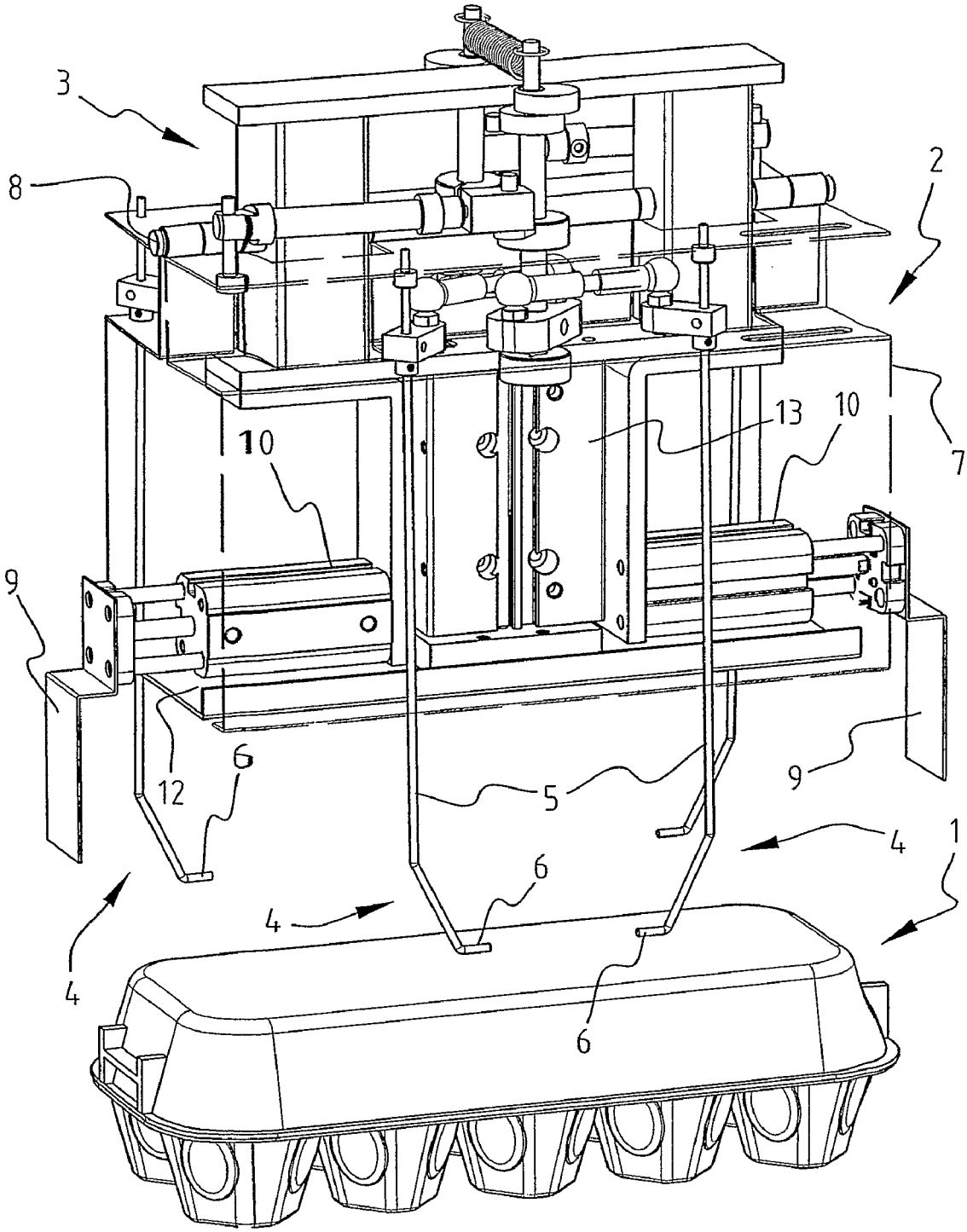
FIG. 1 is a perspective view of a gripping device for placing egg boxes in an outer packaging according to the invention.
Figure 2:
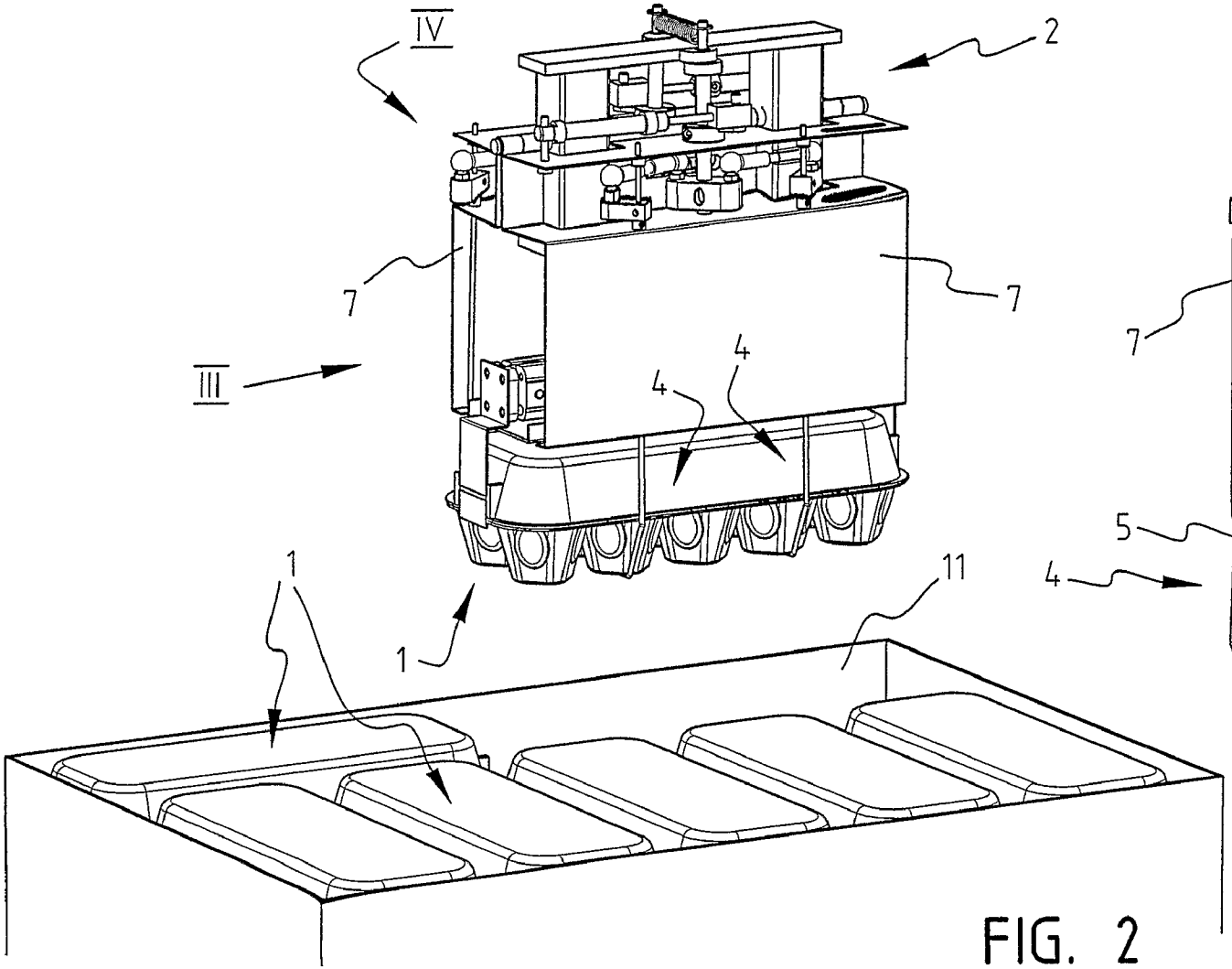
FIG. 2 is a step of the method for placing egg boxes in an outer packaging according to the invention with the aid of the gripping device shown in FIG. 1.

In FIG. 1, an egg box 1 and a gripping device 2 for placing an egg box 1 in an outer packaging 11 are shown. The gripping device 2 comprises a mobile frame 3 and grippers 4 mounted in the frame 3 that when used are situated on both sides of the egg box 1. The grippers 4 can further be moved between a position supporting the egg box 1 (FIG. 2) and an unloading position (FIG. 1). In the position supporting the egg box 1, the grippers 4 support the egg box 1 at or near its base, as is shown in FIG. 2. The egg box 1 therefore rests with its base on the grippers 4. In the unloading position as shown in FIG. 1, the grippers 4 can be retracted from the egg box 1 without hindering thereby the egg box 1 or other adjacent egg boxes (see, for instance, FIG. 2).

Figure 3:
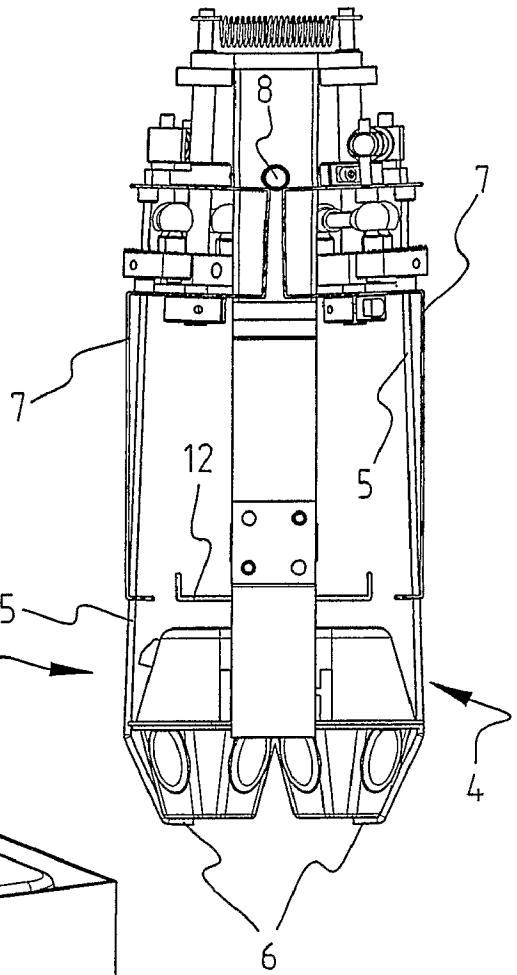
FIG. 3 is a side view according to arrow III in FIG. 2.

Each gripper 4 is formed by a pen 5 with a hook-shaped end 6, which in the position supporting the egg box 1 is situated against the base of the egg box (see FIG. 3). The lower part of each pen 5 has a configuration that is adapted to the egg box 1, which is also best illustrated by FIG. 3. In the unloading position, the pens 5 are rotated in such a manner that the hook-shaped ends 6 are situated parallel to the sides of the egg box 1.

In relation to the egg box 1, the grippers 4 are applied nearer to the centre of the egg box 1 on the one side of the egg box, whereas on the other side of the egg box 1 the grippers 4 are applied nearer to the short sides of the egg box 1 (whereby these two latter grippers are not visible in FIG. 2). Therefore, the grippers 4 on the one side of the egg box 1 are applied staggeringly in relation to the grippers 4 on the other side of the egg box 1. If in a packaging machine to be discussed hereunder in further detail for placing egg boxes 1 in an outer packaging 11 where various gripping devices 2 are used next to each other, the grippers 4 of gripping devices 2 situated next to each other will not hinder each other.

The grippers 4 are connected to the frame 3 with sideboards 7. The sideplates 7 can be swung outwards to several degrees in the frame 3 in relation to a hinge 8. Therefore, the grippers 4 can be moved apart from the position shown in FIG. 3.

In addition, centering elements 9 are included in the frame 3, which in use grip the short ends of the egg box 1. The centering elements 9 are moved into and out of their working positions with the aid of cylinders 10. In their working positions, the centering elements 9 grip the egg box 1, whereby apart from a centering of the egg box 1 also a fixation of the egg box 1 during movements of the gripping device 2 is obtained. The centering elements 9 also serve as guiding plates during the unloading of the egg box 1 into the outer packaging 11.

Furthermore, a pressing element 12 is included in the frame 3, which is also mounted in the frame 3 by way of a cylinder 13 or similar means, so that it can be moved. During the unloading of the egg box 1 into the outer packaging 11, the pressing element 12 presses on the top of the egg box 1.

As a result of this, the grippers 4 can be retracted without taking the egg box 1 with them. The pressing element 12 can also serve to close a slightly open lid of the egg box 1 during the lifting or during the placing of the egg box 1 in the outer packaging 11.

The working of the gripping device 2 according to the invention will now be illustrated by way of the FIGS. In FIG. 1, the point of departure of the gripping device 2 is shown in relation to an egg box 1 to be lifted. The gripping device 2 is lowered, until the hook-shaped ends 6 of the pens 5 are situated at the level of the base of the egg box 1. First, the egg box 1 is centered in relation to the frame 3 of the gripping device 2 by way of pulling in the centering elements 9. Subsequently, the pens 5 are rotated a quarter turn, so that their hook-shaped ends 6 become situated under the base of the egg box 1. With the rotation of the pens 5, the sideplates 7 are swung inwards, so that the egg box 1 is fully fixated (FIG. 2 and FIG. 3). The frame 3 is transported to the outer packaging 11, and with the aid of the gripping device 2 the egg box 1 is lowered into the outer packaging 11 to the position in which it will be let loose. The pens 5 are now rotated back a quarter turn, so that the hook-shaped ends 6 become situated parallel to the sides of the egg box 1. The sideplates 7 are now free now to swing outwards. Subsequently, the frame 3 with the pens 5 is retracted from the outer packaging 11, whereby at the same time the pressing element 12 is pushed outwards, so that the pressing element 12 presses the egg box 1 and the pens 5 do not get stuck at the sides of the egg box 1 during the return twist of the gripping device 2. Then, the gripping device 2 can. subsequently start to lift a following egg box.

Figure 4:
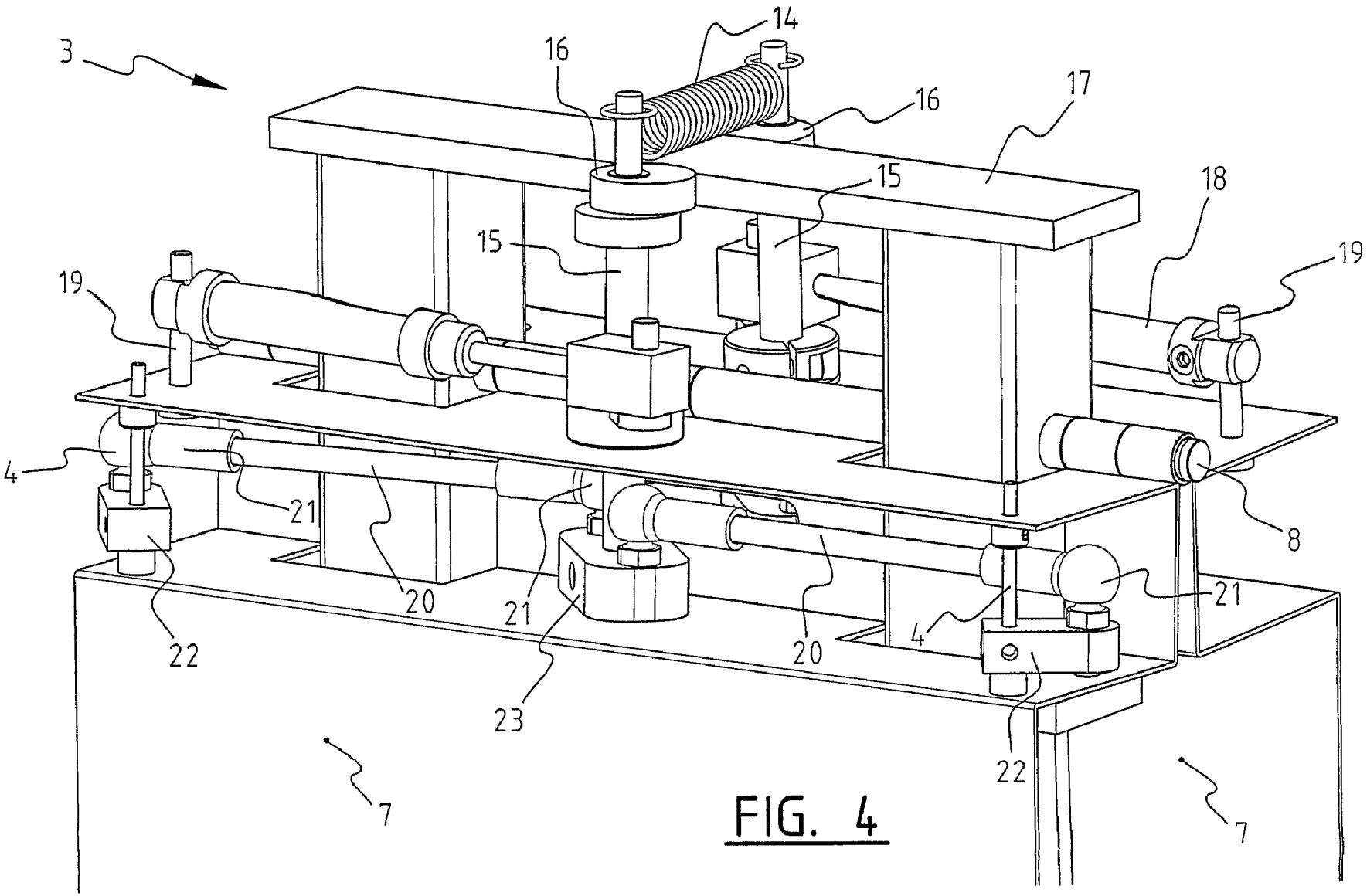
FIG. 4 is a perspective detailed view according to arrow IV in FIG. 2.
Figure 5A:
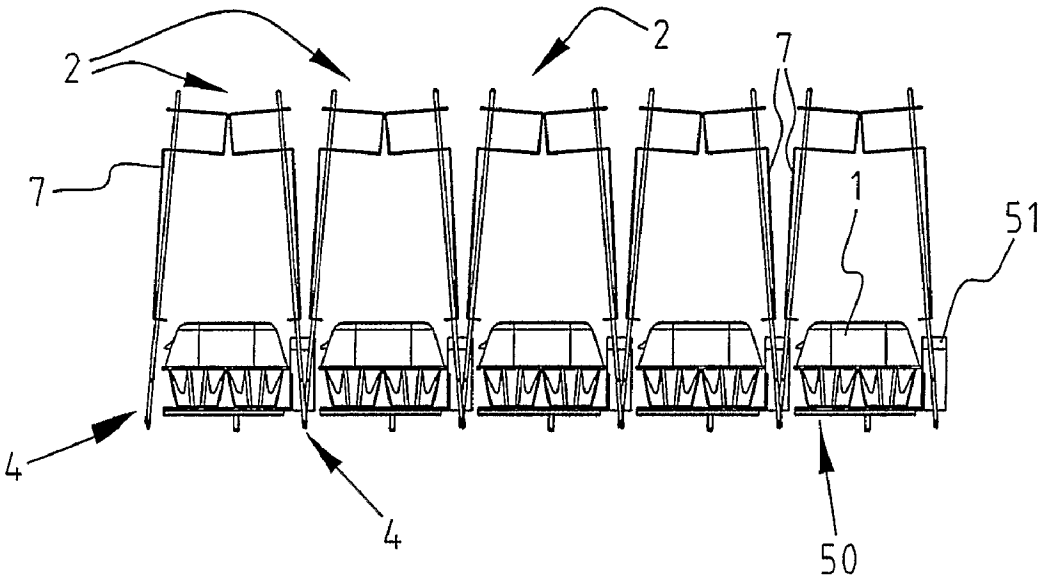
FIGS. 5A-C are three different steps of the method according to a first example.
Figure 5A:
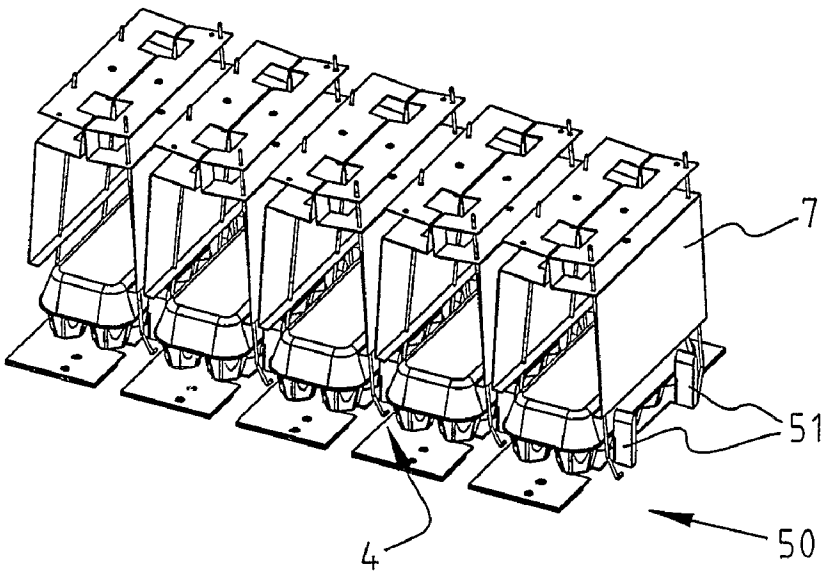
Figure 5B:
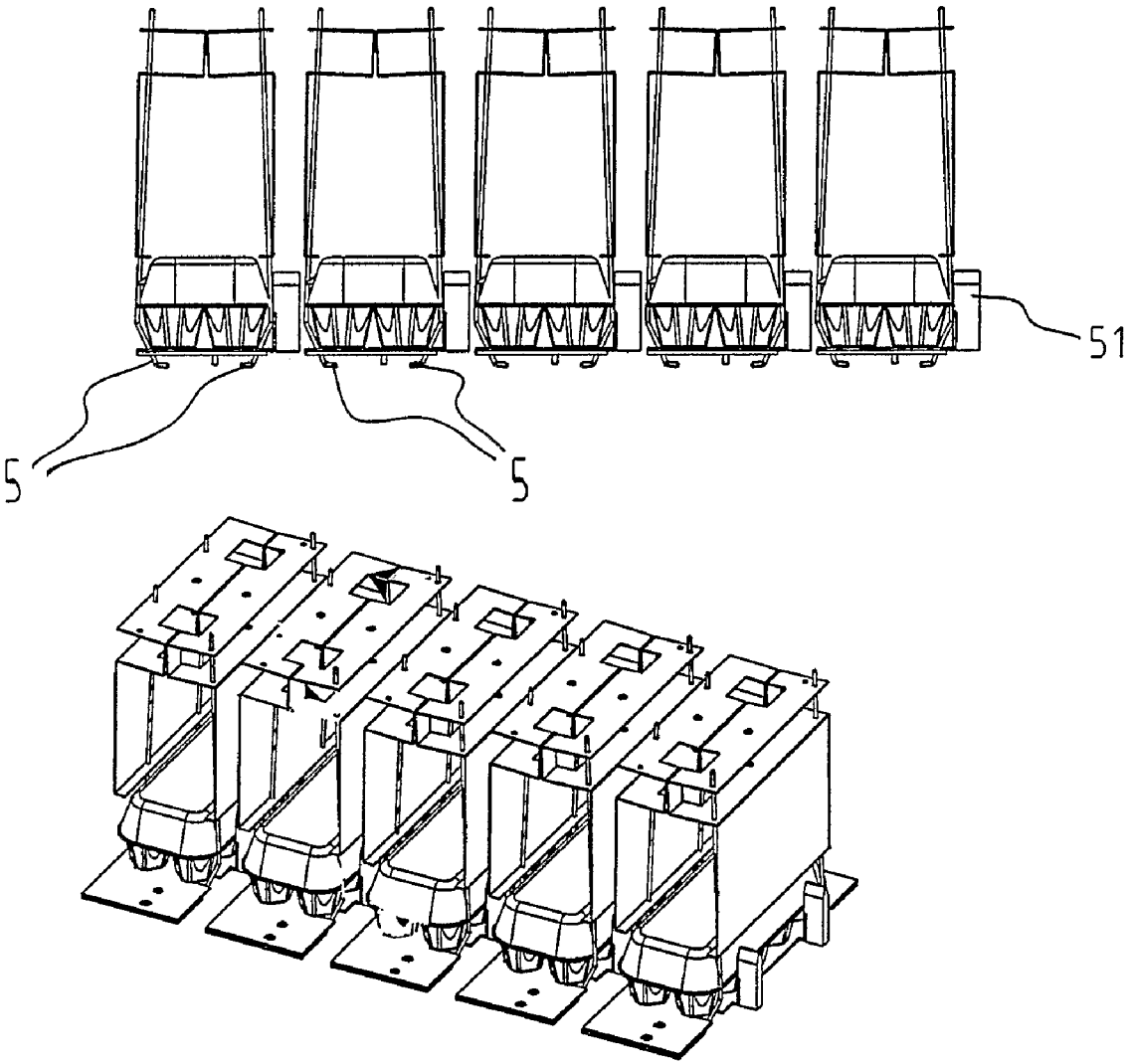
Figure 5C:
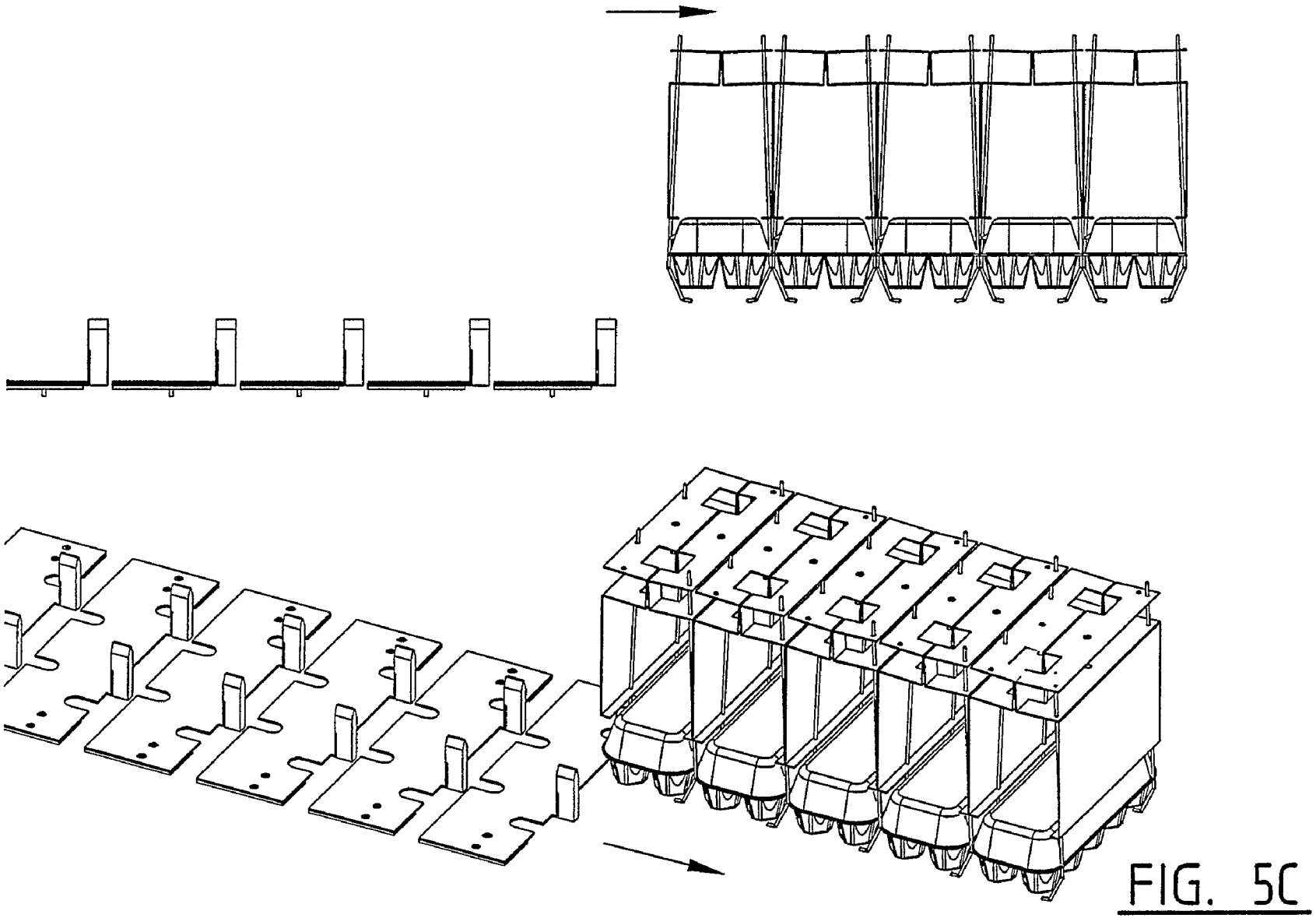
Figure 6A:
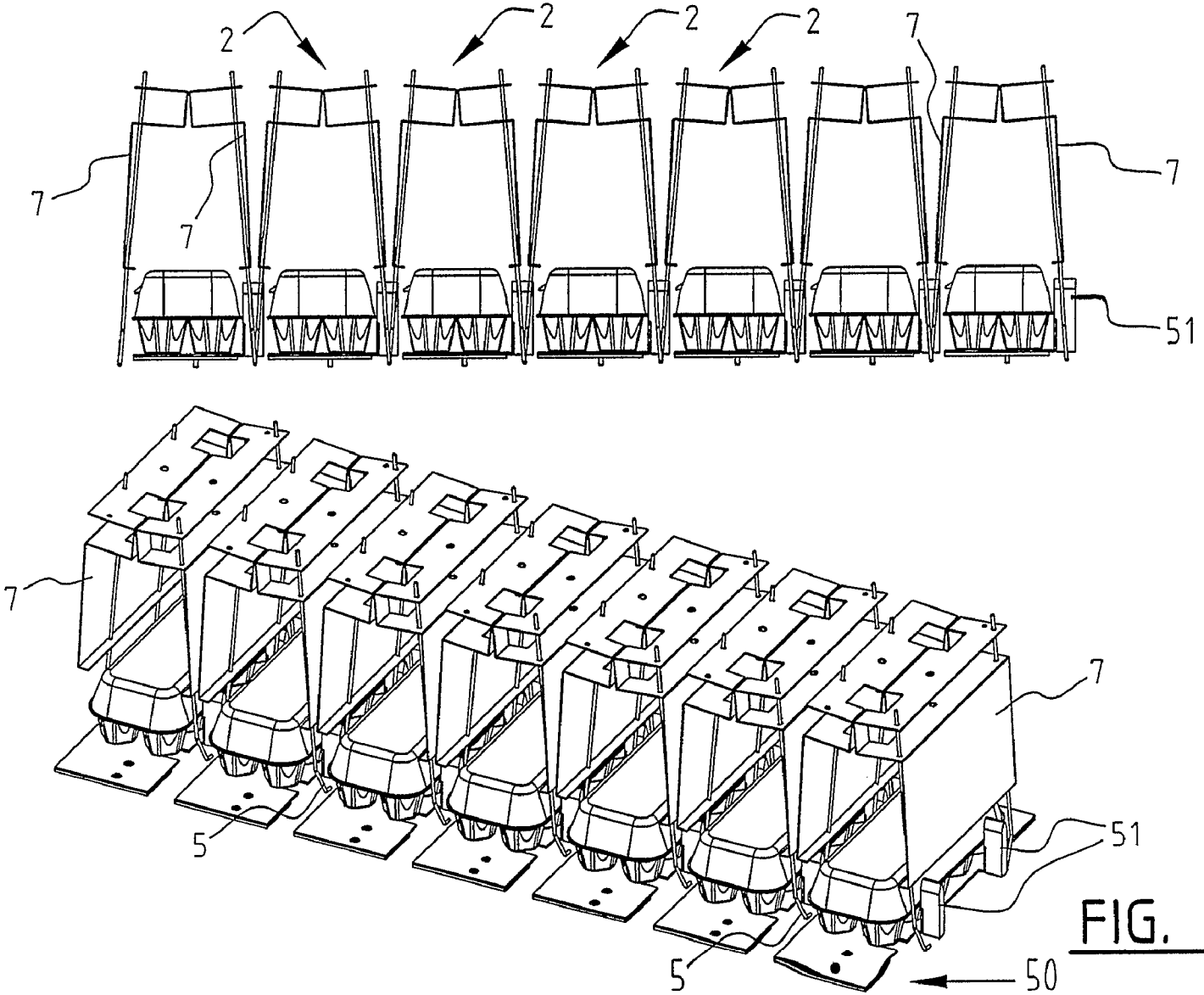
FIGS. 6A-D are four different steps of the method according to a second example.
Figure 6B:
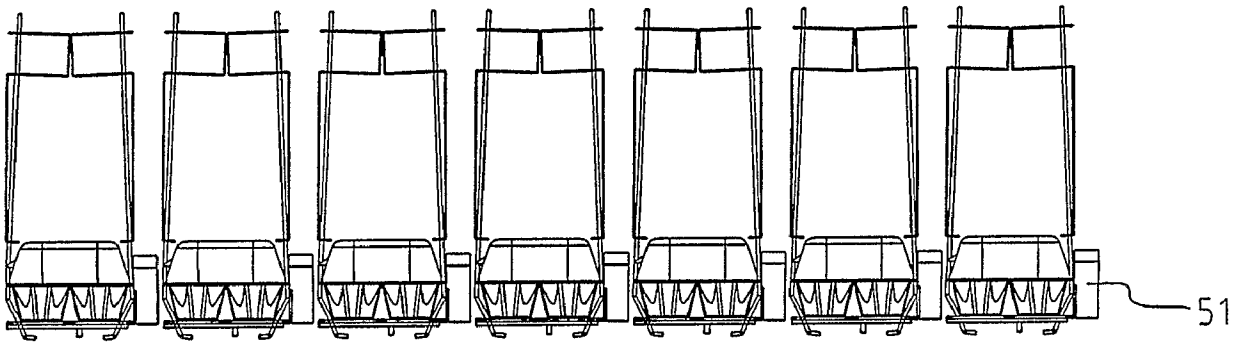
Figure 6B:
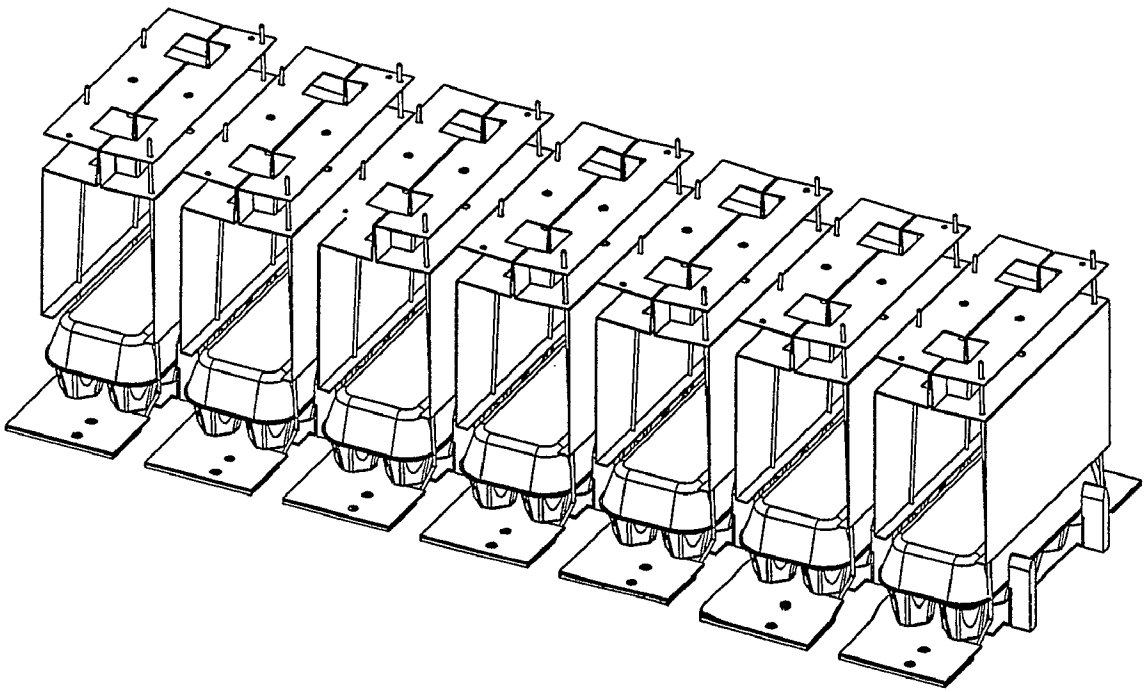
Figure 6C:
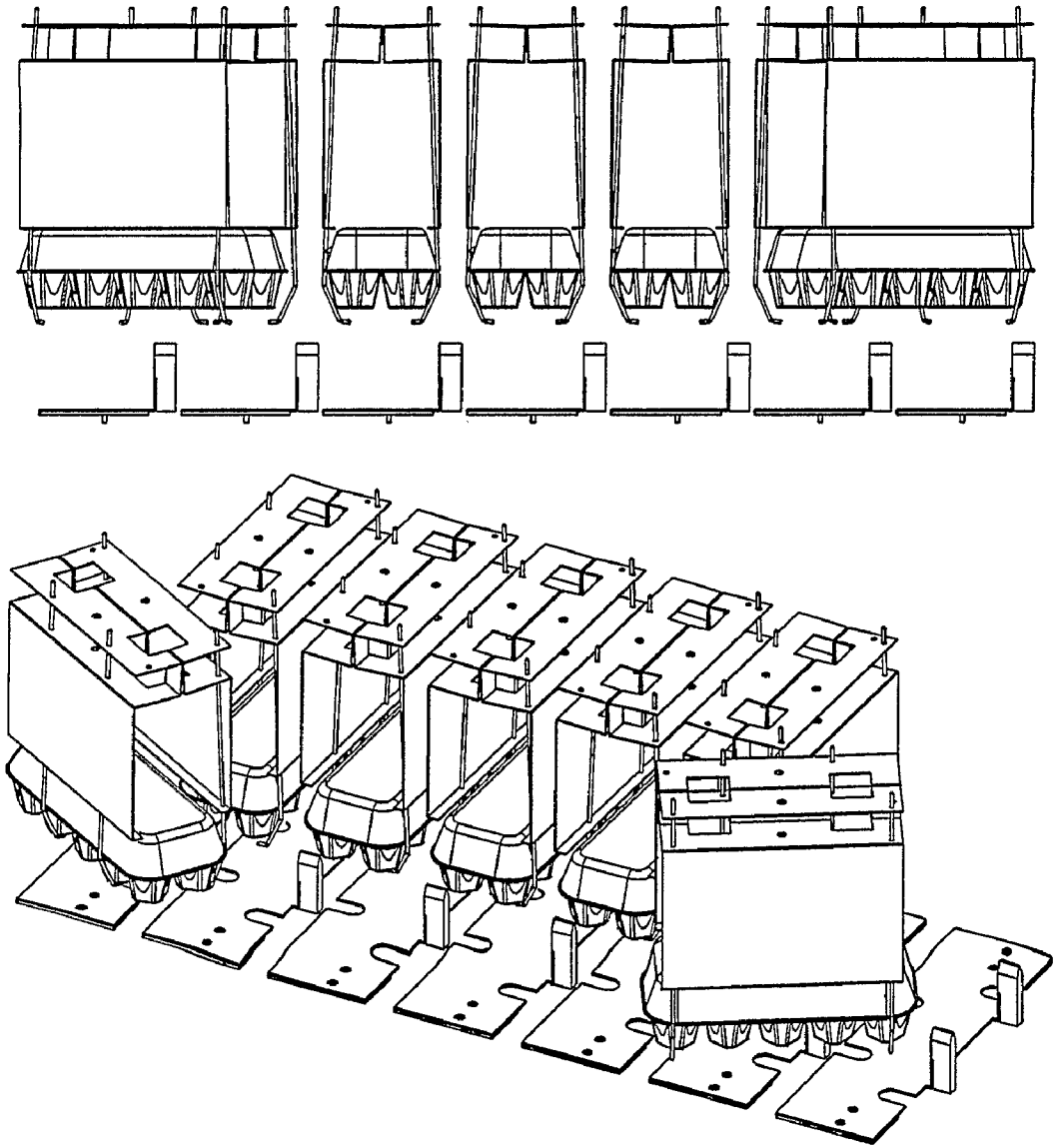
Figure 6D:
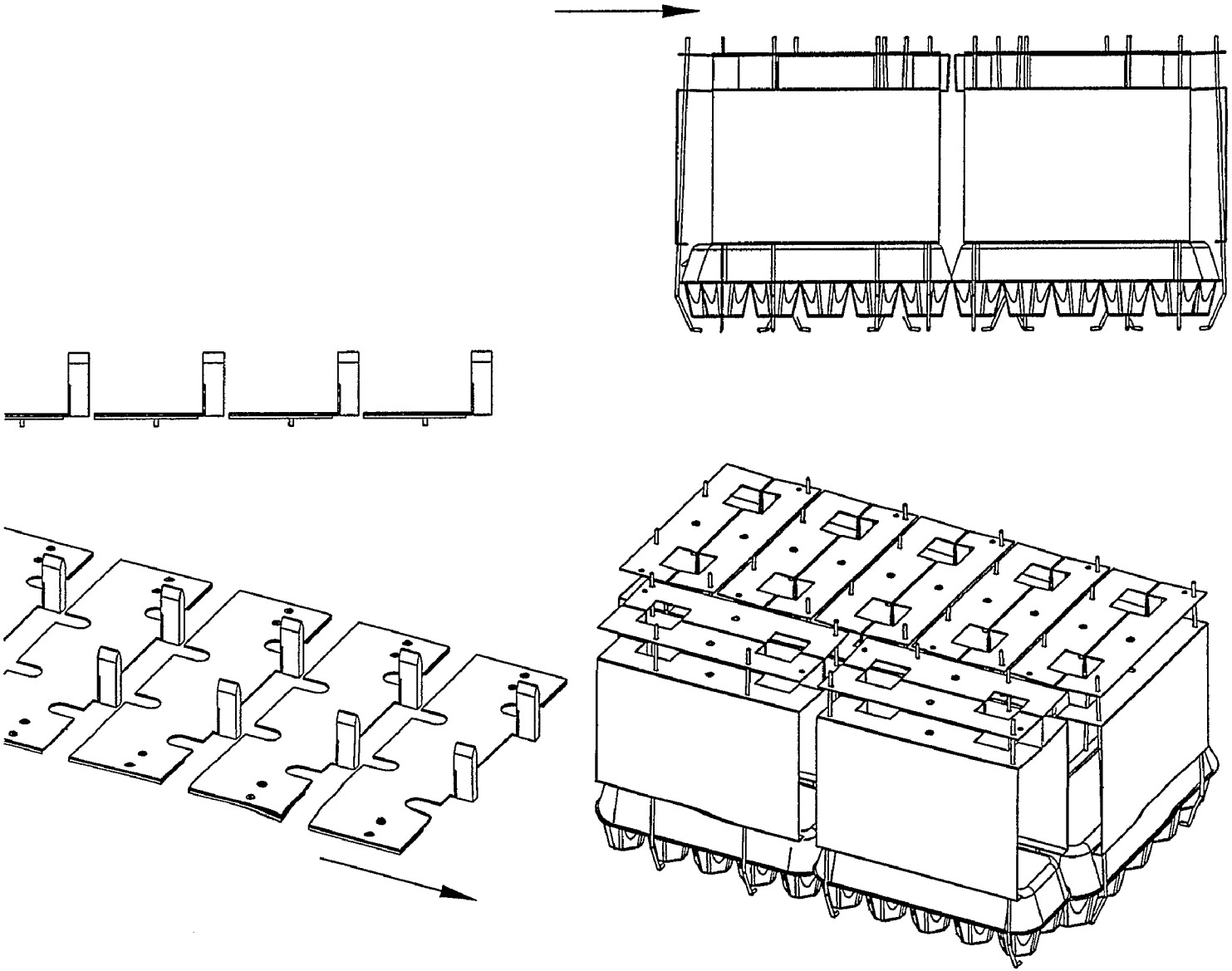

In FIG. 4, a detailed view of the top of the gripping device 2 is shown. At the top of the gripping device, in the frame 3, the mechanism is situated for rotating the grippers 4 and swinging the sideplates 7. This mechanism comprises two main shafts 15 mounted at both sides of the frame 3. The main shafts extend downwards through the sideplates 7. At the top, an eccentric 16 is mounted to each main shaft 15. The eccentrics 16 combine with a top plate 17 of the frame 3. The eccentrics are joined to each other by the spring 14 for resetting the sideplates 7. In addition, the mechanism comprises cylinders 18, each applying to a main shaft 15 about halfway its height. On the outside of the frame 3, the cylinders 18 are joined to the frame 3 and can hinge around a shaft 19. Finally, the mechanism comprises four arms 20, one for each gripper 4, and only two of which are visible in FIG. 4. Each arm 20 is connected on the one side to a gripper 4 and on the other side to the main shaft 15, close to its base. The arms 20 have ball hinges at both ends, by way of which they are connected to blocks 22 and 23, respectively, which are mounted to the grippers 4 and the main shafts 15, respectively. The blocks 22 and 23, respectively, are mounted non-revolving to the grippers 4 and the main shafts 15, respectively, in such a way that these blocks 22,23 rotate in conjunction with the grippers and main shafts, respectively.

At the point of departure, the cylinders 18 are in their pulled-in position and the eccentrics 16 are in contact with the top plate 17 of the frame 3 at a circumferential point with a small radius. Due to this, the grippers 4 and the sideplates 7 are situated in the position shown in FIG. 1, i.e. the hook-shaped ends 6 of the grippers 4 are situated parallel to the egg box 1, and the sideplates 7 are swung outwards at an angle of several degrees. In order to be able to pick up an egg box 1, the cylinders 18 are extended, so that the main shafts 15 are rotated. With the rotation of the main shafts 15, the blocks 23 are also rotated, taking with them the arms 20. The arms 20 in their turn ensure that the blocks 22 and the grippers 4 attached to them are rotated. The turn of the cylinders 18 corresponds to a quarter turn rotation of the grippers 4. In addition, with the rotation of the main shafts 15, the eccentrics 16 will be rotated. The eccentrics 16 will contact the top plate 17 of the frame 3 at a circumferential point with a large radius, so that they press against the top plate 17 and the main shafts 15, taking with them the sideplates 7, move toward each other. In doing so, the sideplates 7 ensure a clamping of the grippers 4 on the egg box 1. At this point, the position shown in FIGS. 2 and 3 is obtained. In order to unload the egg box 1, the cylinders 18 are retracted and, as a result of the rotation of the main shafts 15, the grippers 4 will turn back. The eccentrics 16 will only release the top plate 17, when several gripping devices 2 are used for delivering a layer of egg boxes. The sideplates 7 of adjacent gripping devices 2 are namely situated against each other, so that the sideplates are hindered during their swinging back to the point of departure. Only when the gripping devices 2 are moved away from each other and space is created between the sideplates 7, each release spring 14 will ensure that the sideplates 7 swing outwards (FIG. 1).

FIGS. 5 and 6 show schematic views (front views left and perspective views right in the drawings) of a packaging machine, wherein various gripping devices 2 are combined and each of these lifts an egg box 1 from a feed belt 50 at the same time. As a result, a layer of egg boxes 1 can be positioned in an outer packaging (not shown) at one and the same time. To that end, after they have each lifted an egg box 1, the gripping devices 2 can be positioned in the pattern of the layer, in order to move as a whole to the outer packaging, or the pattern is formed during the joint transport of the gripping devices 2 to the outer packaging. The gripping devices 2 simultaneously lower the egg boxes 1 into the outer packaging, the grippers 4 are simultaneously moved from the position supporting the egg box 1 to the unloading position, and the gripping devices 2 are simultaneously retracted, whereby the pressing elements (not shown) will press on the tops of the egg boxes 1. Because the sideplates 7 of adjacent gripping devices 2 are situated against each other, the sideplates 7 are not free to swing outwards during the unloading of the egg boxes. Only when the gripping devices 2 move apart, the sideplates will swing outwards under the influence of a release spring. Because the outer dimensions of the gripping device, and in particular at the level of the grippers 4, equal the dimensions of the egg box 1, the egg box 1 can be unloaded in very limited spaces in the outer packaging. Due to the special forms and positions of the pens 5, the risk of hitches during their retraction is minimised.

The first example according to FIG. 5 places five egg boxes next to each other in a layer that has to be placed in an outer packaging. In FIG. 5A, the egg boxes are individually positioned by the feed belt 50 under the gripping devices 2. In order to keep the egg boxes apart from each other, the feed belt 50 is provided with distance blocks 51. In addition, openings (hardly visible) have been made in the feed belt for the passage of the pens 5 during the lifting of the egg boxes. The sideplates 7 have open hinges. At the same time, the pens 5 are turned lengthwise, i.e. with the hook-shaped ends situated parallel to the long side of the egg box. Subsequently, the sideplates 7 are closed by way of the hinges (FIG. 5B) and the pens 5 are rotated into a transverse position, i.e. with the hook-shaped ends under the base of the egg boxes. During the transport of the gripping devices 2, as shown in FIG. 5C, the egg boxes are lined up in the right position. The formation is ready at the moment that the group of gripping devices 2 has arrived over the outer packaging. The lined up layer of egg boxes is placed in the outer packaging at one and the same time, all this as described above.

FIG. 6 shows a second example for the formation of a layer of egg boxes. In FIG. 6A, the egg boxes are individually positioned under the gripping devices 2 by the feed belt 50. The sideplates 7 are opened by way of their hinges and the pens are situated lengthwise. In FIG. 6B, the sideplates 7 are closed by way of their hinges, and the pens 5 are rotated into their transverse position. In FIG. 6C, the formation of the layer is started, while preferably the group of gripping devices 2 is already being transported to the outer packaging. The five middle gripping devices are lined up, whereas the outer gripping devices are rotated to the right and left, respectively. For that matter, when forming the following layer to be formed, the outer heads are turned in the opposite directions in order to bond the layers. FIG. 6A shows the situation over the outer packaging. The layer formed can be placed in the outer packaging.

In the FIGS. 5 and 6, it is clearly visible that the pens of the same gripping device 2 have been attached to the frame staggeringly in relation to each other in such a way that the pens 5 of adjacent gripping devices 2 cannot touch or hinder each other. When the sideplates 7 are in the swung-open position, the pens 5 of adjacent gripping devices 2 are in line (seen in a direction that is transverse in relation to the feed belt 50). Of course, various formation patterns are possible. All this depends on the dimensions of the egg box.

The invention claimed is:

1. A gripping device for placing a box having two opposite sides and a base in an outer packaging for the box, the gripping device comprising:

a mobile frame having two opposite frame sides and a frame axis that extends substantially vertically;

first and second sets of discrete grippers connected to respective opposite sides of the frame such that in a use position each set of grippers is situated on opposite sides of the box;

each discrete gripper having a slender pen-shaped body and a hook-shaped distal end, the slender pen-shaped body of each gripper having a longitudinal axis that is substantially parallel to the vertical frame axis, and the hook-shaped distal end of each gripper extending substantially perpendicular to the longitudinal axis of the associated pen-shaped body;

each discrete gripper being rotatable along a rotation axis that is substantially parallel to the longitudinal axis of the pen-shaped body so that each discrete gripper can be rotated between a box supporting position in which the hook shaped ends extend substantially perpendicular to the opposite sides of the frame and hence substantially perpendicular to the opposite sides of the box and under the base of the box, and an unloading position in which the hook-shaped ends extend substantially parallel to the opposite sides of the frame and hence substantially parallel to the opposite sides of the box; and the discrete grippers of the first set connected on one opposite side of the frame are positioned staggeringly in relation to the grippers of the second set connected on the other opposite side of the frame.

2. The gripping device according to claim 1, wherein the grippers are attached to the frame swivelling in relation to each other.

3. The gripping device according to claim 1, wherein the grippers grip the box under a bottom of a base thereof in the box supporting position.

4. The gripping device according to claim 1, wherein the pen-shaped body has a mainly circular cross section in a plane perpendicular to the longitudinal axis thereof.

5. The gripping device according to claims 1, further comprising centering elements for centering the box in relation to the frame.

6. The gripping device according to claim 5, wherein the box has two opposite short sides that extend perpendicular to the two opposite sides, and wherein the centering elements are adapted to engage the two opposite short sides of the box.

7. The gripping device according to claims 1, further comprising a pressing element that can be moved in relation to the frame, said pressing element pressing a top of the box at least in the unloading position.

8. A packaging machine for packing boxes, in an outer packaging therefore, the packaging machine comprising:

a feed belt for feeding the boxes, a filling point on which an outer packaging to be filled with boxes can be placed, and at least one gripping device according to claim 1 for placing boxes into the outer packaging.

9. The packaging machine according to claim 8, wherein a plurality of gripping devices positioned next to each other are provided, and the gripping devices can jointly be moved between the feed belt and the filling point.

10. The packaging machine according to claim 9, wherein the gripping devices can be moved in relation to each other.

11. The packaging machine according to claim 8, wherein the feed belt is provided with openings for the passage of the grippers.

* * * * *